US006989516B1

(12) United States Patent
Domoto

(10) Patent No.: US 6,989,516 B1
(45) Date of Patent: Jan. 24, 2006

(54) SYSTEMS AND METHODS FOR INDUCTION HEATING OF A HEATABLE FUSER MEMBER USING A FERROMAGNETIC LAYER

(75) Inventor: Gerald A. Domoto, Briarcliff Manor, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/948,318

(22) Filed: Sep. 24, 2004

(51) Int. Cl.
*H05B 6/14* (2006.01)

(52) U.S. Cl. ..... 219/619; 219/216; 399/328

(58) Field of Classification Search ..... 219/619, 219/216; 399/328, 330, 334
See application file for complete search history.

(56) References Cited

U.S. PATENT DOCUMENTS

| | | | | |
|---|---|---|---|---|
| 6,021,303 | A | 2/2000 | Terada et al. | |
| 6,580,895 | B2 * | 6/2003 | Hirst et al. | 399/330 |
| 2005/0141931 | A1 * | 6/2005 | Domoto et al. | 399/328 |

* cited by examiner

*Primary Examiner*—Quang Van
(74) *Attorney, Agent, or Firm*—Oliff & Berridge, PLC

(57) ABSTRACT

A ferromagnetic layer is bonded to, or coated on, or in other manner applied to, the surface of a heatable fuser member for fusing dry toner in an image forming device. The ferromagnetic layer promotes inductive heating of the heatable fuser member based on high hysteresis loss exhibited when the ferromagnetic layer is exposed to a magnetic field created by the current flowing through an induction coil or other like device. Suitable materials for the ferromagnetic layer are those which exhibit a high coupling efficiency to the imposed magnetic field. A result is substantially controllable, consistent heating of the heatable fuser member to fuse dry toner onto or into the image bearing surface of an image receiving medium.

18 Claims, 3 Drawing Sheets

SYSTEMS AND METHODS FOR INDUCTION HEATING OF A HEATABLE FUSER MEMBER USING A FERROMAGNETIC LAYER

BACKGROUND OF THE INVENTION

1. Field of Invention

This invention is directed to systems and methods for fusing toner on image receiving mediums in image forming devices.

2. Description of Related Art

A variety of systems and methods are conventionally used to fuse toner particles on a variety of image bearing surfaces of image receiving mediums in image forming devices. Generally, such systems and methods involve a heated pressing surface usable to melt and press dry toner, which has been deposited on the image bearing surface of the image receiving medium in a preceding step of forming an image, onto or into the image bearing surface, thereby fusing the image on the image receiving medium.

Typical conventional systems and methods for fusing dry toner onto or into an image bearing surface of an image receiving medium in an image forming device include, for example, using what is commonly referred to as a hot roll fusing device to provide the heated pressing surface usable to melt and press the toner onto or into the image bearing surface of the image receiving medium. Such a hot roll fusing device 100 is shown, in exemplary manner, in FIG. 1. As shown in FIG. 1, the hot roll fusing device 100 includes a heated fuser roller 110 and an opposing pressure roller 120, the two rollers 110, 120 rotating respectively in directions depicted as arrows 115 and 125. The heated fuser roller 110 is formed of a hollow tube with a cylindrical surface 130 which may be closed at the ends with end caps 135 which may have vent holes as depicted. The heated fuser roller 110 contains a heat source in the form of a heating element 140.

Typical heating elements 140 usable to heat the cylindrical surface 130 of the heated fuser roller 110 are, for example, quartz rods or lamps. The cylindrical surface 130 of the heated fuser roller 110 may be configured of a hard metal or other rigid highly heat conductive substance and may optionally include an external heat-conductive coating such as, for example, Teflon® or the like. An objective of the construction of the heated fuser roller 110 is to conduct heat generated in the heating element 140 through the cylindrical surface 130 of the heated fuser roller 110 to the receiving medium 200 in order that toner, previously deposited on the image bearing surface of the image receiving medium 200, can be melted and pressed and therefore fused thereon.

Consistent, controllable heating along the entire axial length of a heated area of the heated fuser roller 110 is desirable in order to avoid any degradation in image quality due to insufficient, varied or excessive heating of the dry toner on the image bearing surface of the image receiving medium.

In order to further facilitate the fusing process in the hot roll fusing device 100, the second element of pressure is added, to supplement the first element of heat applied through the cylindrical surface 130 of the heated fuser roller 110, with inclusion of the pressure roller 120 that opposes the heated fuser roller 110. The pressure roller 120 is typically configured with a soft outer layer of, for example, silicon, rubber, or a silicon rubber shell. The pressure roller 120 presses firmly against the heated fuser roller 110. A softer surface on the pressure roller 120 provides additional surface-to-surface contact between the pressure roller 120 and the heated fuser roller 110 as the softer surface of the pressure roller 120 limitedly conforms itself to more of the heated cylindrical surface 130 of the heated fuser roller 110 than simply at a single line tangential to each roller where two hard rollers would interact. This limited conforming of the heated and pressure roller surfaces results in an increased exposure of any given point on the receiving medium 200 to the heat and pressure generated in the hot roll fusing device 100 by the contact on either side of the receiving medium 200 of the pressure roller 120 and the opposing heated fuser roller 110. The pressure, spread over more than a single tangential line between the two rollers 110, 120, facilitates heating and pressing of the toner to melt and press, and thereby fuse the toner onto or into the image bearing surface of the image receiving medium 200.

Such conventional systems thus facilitate fusing of toner on image receiving mediums 200 by melting the toner and simultaneously forcing the melted toner into the image bearing surface of the image receiving mediums 200. The softer the pressure roller 120, within certain limits, the better the surface of the pressure roller 120 conforms to the heated surface 130 of the heated fuser roller 110 forming the slightly larger contact area between the two rollers 110, 120. This contact area is commonly referred to as the nip.

In order to promote the highest quality image production and/or reproduction in image forming devices employing heat and pressure to fuse toner on an image receiving medium, it is desirable to provide controllable, consistent heat across an entire axial length of the cylindrical surface 130 of the heated fuser roller 110 with an objective of consistent heat and pressure on the image bearing surface of the image receiving medium 200. It is further desirable to control the temperature of the heated fuser roller 110 in a range that ensures that enough heat is supplied to melt the toner and thereby fuse the toner onto or into the image bearing surface of the image receiving medium 200, but that also ensures that not so much heat is supplied that image quality could be impaired, damage to the image or the image receiving medium 200 could occur, or damage to the hot roll fusing device 100 in the image forming device could result.

Maintaining uniform axial temperature along the entire cylindrical surface 130 of the heated fuser roller 110 has proven difficult to achieve in traditional hot roll fusing devices 100 such as the one depicted in exemplary manner in FIG. 1. Failure to maintain uniformity in temperature along an entire cylindrical surface 130 of a heated fuser roller 110 can result in impaired image quality because ineffective melting of toner can occur at positions which are relatively cooler, and image distortion and/or image offset can occur at relatively hotter axial locations.

In an effort to overcome these shortfalls, various systems and methods are employed. Careful selection of the material from which the heated fuser roller 110 is formed in an attempt to produce a heated fuser roller 110 whose cylindrical surface 130 has high, yet consistent, heat conductivity limits the selection of materials from which such a heated fuser roller 110 can be manufactured. A further limitation on the selection of heat conductive materials from which the heated fuser roller 110 is formed is consideration of reducing the overall thermal mass of the heated fuser roller 110 in order to minimize warm-up time required to bring the heated fuser roller 110 to a sufficient operating temperature to ensure melting of the toner.

Alternatively, a method for dealing with non-uniformity in the temperatures, particularly in image forming devices which accommodate varying widths of image receiving mediums 200, is to provide multiple hot roll fusing devices 100, such as that shown in exemplary fashion in FIG. 1, of varying widths within a single image forming device, or to incorporate multiple heating elements 140 in a single hot roll fusing device 100 that may be selectively employed to heat certain portions of heated fuser roller. Such built-in redundancy, while effective in increasing image quality, has the disadvantage of increasing the complexity of the image forming device. Such increased complexity will tend, for example, to adversely impact cost of manufacture of image forming devices and/or costs associated with maintenance of the devices and/or costs associated with production of images from such devices.

U.S. patent application Ser. No. 10/749,284, by the same inventor and commonly assigned, which is incorporated herein by reference in its entirety, discloses an improved hot roll fusing station and hot roll fusing method. An objective of the invention disclosed in the '284 application is to overcome at least the disadvantages enumerated above by providing a heated fuser member possessing consistent, controllable heating along an entire axial length. This objective is achieved by introducing electrical coils which are substantially co-axial to the heated fuser member and are positioned around or near at least one end of the heated fuser member and that are otherwise suitable for inductive coupling with the fuser member to inductively heat the fuser member when the electrical coil is energized with electrical power. The '284 application attempts to ensure consistent axial heating through the use of a heat pipe, i.e., a sealed hollow cavity which contains a working fluid. Such working fluid is optionally water, methanol or a combination of those, or another suitable working fluid in a multi-phase mixture with a liquid phase and corresponding vapor phase maintained in equilibrium. Employing such a working fluid, while better providing consistent axial heating, increases the complexity and, potentially, the serviceability of the disclosed heated fuser member, such as, for example, by requiring equipping the heated fuser member with a pressure relief system in order to protect against overpressurization.

The systems and methods disclosed in the '284 application realize a broadening of the options regarding the materials from which a heated fuser roller or heat pipe can be manufactured. For example, electrically conductive magnetic walled tube materials and electrically conductive non-magnetic walled tube materials are disclosed. It should be noted that typical heat pipes using water as a working fluid are constructed of copper or cupro-nickel materials. These materials, while exhibiting high electrical conductivity, may not be the most suitable for supporting induction heating.

Additionally, typically an over-temperature sensor is provided which is usable to induce an automatic slow down or cool down period or to ultimately interrupt processing within the image forming device completely. The objective of such a over-temperature sensor is to limit the possibility of damage to the image, the image receiving medium, or the image forming device based primarily on an uncontrolled or abnormal overheat condition in the hot roll fusing device.

U.S. Pat. No. 6,021,303 to Terada et al., the disclosure of which is incorporated herein by reference in its entirety, teaches generally an image heating device including a cylindrical heating roller and an internal magnetization coil for magnetizing the heating roller with an alternating magnetic field. This patent introduces a concept where, by selecting a Curie temperature for the magnetizing member, the heating roller temperature is self-regulated to stabilize at a temperature that is suitable for fusing toner on the image bearing surface of an image receiving medium. Specifically, a single or multiple layer heating roller that includes, as the single layer, or as one of the multiple layers, covering an entire span-wise heatable area of the fuser roller, a magnetic alloy. In an effort to ensure consistent heating across the entire span-wise heated area of the disclosed heating roller or member, the magnetization coil, located inside the heating roller, covers an entire span-wise heated portion of the heating roller.

SUMMARY OF THE INVENTION

It is desirable to simplify the complexity of image forming devices in which exemplary hot roll fusing devices 100, such as the one depicted in FIG. 1, are housed to the maximum extent possible. Adding redundant components and providing complex span-wise magnetic induction coils do little to reduce the complexity of the components themselves and therefore the image forming devices in which they are installed. Simplifying, or avoiding the need for, over-temperature sensors would further aid in achieving an overall reduction in complexity of an image forming device.

As was noted briefly above, it is also desirable, where possible, to reduce the warm-up time required to bring a heated fuser roller to a consistent axial temperature which is high enough for toner melting and fusing operations while limiting power consumption in the image forming device. Overall power consumption can be reduced in a number of ways such as, for example, (1) reducing the thickness of the heated surface of a heated fuser roller thereby reducing the thermal mass of the roller, (2) not requiring the system to be maintained in a pre-heated (standby) condition, and/or (3) by not requiring excessive power draw in order to rapidly heat the heated fuser roller. As such, the objectives of shortening warm-up time and limiting power consumption should be optimized in a system and method which accounts for warm-up time and power consumption, and balances each in consideration of the other.

It has been found that attempting to fashion heated fuser rollers and/or heat pipes out of ferromagnetic materials is difficult. As such, in an effort to gain a benefit of induction heating of such heated fuser rollers and/or heat pipes, a different approach is desirable.

In various exemplary embodiments, the systems and methods according to this invention seek to overcome the shortfalls identified above, and to further increase the efficiency and effectiveness of an exemplary heated member fusing device for melting and pressing, and thereby fusing, dry toner onto or into the image bearing surface of an image receiving medium in an image forming device.

In various exemplary embodiments of the systems and methods according to this invention, a ferromagnetic layer, or a layer with high coupling efficiency to an imposed magnetic field, is positioned on a portion of a heatable fuser member, such as, for example, a heated fuser roller or a heat pipe, outside the image receiving medium contact area where the heatable fuser member contacts image receiving mediums. The ferromagnetic layer, or layer with high coupling efficiency to the imposed magnetic field can be inductively heated by externally mounted induction coils to in turn heat the image receiving medium contact area of the heatable fuser member.

In various exemplary embodiments, the systems and methods according to this invention further provide an inductively-heatable ferromagnetic layer on a portion of a heatable fuser member. The ferromagnetic layer may be in the form of a reasonably solid ferromagnetic sleeve or end cap such as, for example, fittable to a portion of a cylindrical surface of a heatable fuser member, or in the form of a suitable ferromagnetic particulate material embedded in a thermally-conductive matrix positioned, for example, on a portion of any suitable heatable fuser member core. A combination of (1) a sleeve and/or end cap and (2) particulate material is also possible. In various exemplary embodiments, the ferromagnetic material may be chosen to exhibit high hysteresis loss when exposed to a magnetic field created by at least one surrounding or adjacent electrical induction coil.

In various exemplary embodiments of the systems and methods according to this invention, a ferromagnetic material is chosen and fabricated to provide increased thermal conductivity to the non-coated portion of the heatable fuser member, preferred materials exhibiting high coupling efficiency to the imposed magnetic field thereby resulting in consistent, controllable axial heating of the heatable fuser member.

In various exemplary embodiments, the systems and methods according to this invention address the problem of poor RF/thermal energy when coupling directly to a single layer heatable fuser member. The systems and methods according to this invention may also avoid the need for a full-span magnetic heated fuser member or magnetic layer on the image contacting portion of the heatable fuser member, and also avoid the need for a coincident span-wise heated area magnetic induction coil. The result is that a heatable fuser member according to various exemplary embodiments of the systems and methods of this invention is not limited in construction, manufacture or molding to the narrow scheme of materials conventionally deemed usable for applications. Rather, a wide array of suitable materials usable for fabricating a heatable fuser member's core is available as the heat generation will occur in a partial-span ferromagnetic layer bonded to, coated on, or in any other like manner applied to, the surface of a heatable fuser member outside the span-wise heated area where contact between the image receiving medium and the heatable fuser member is effected.

In various exemplary embodiments of the systems and methods according to this invention, uniformity of axial temperature and reduced warm-up periods may be realized while limiting power consumption associated with such warm-up by broadening the range of available materials from which the heatable fuser member core can be fabricated. The ability may be provided to optimize the mass by selecting materials which can be manufactured into thin yet rigid heatable fuser members.

In various exemplary embodiments of the systems and methods according to this invention, improved image quality may be realized by ensuring consistent, controllable temperature uniformity across the entire axial length of the surface of the heatable fuser member such as, for example, limiting temperature variation to less than or equal to about 5° C.

In various exemplary embodiments, the systems and methods according to this invention may provide internal temperature self-control by utilizing a ferromagnetic layer fabricated from a ferromagnetic material with a Curie point that is higher than the melting point of the dry toner used in the image forming device but lower than a temperature at which image quality begins to deteriorate or damage to an image, image receiving medium or image forming device may occur. The self-temperature-limiting is effected because above the Curie temperature for a ferromagnetic material, the material loses its ferromagnetic properties, and a hysteresis heating process naturally suspends. The resulting benefit, where the maximum temperature obtainable in a heatable fuser member becomes limited, may then reduce and/or eliminate the need for multiple span-wise temperature feedback sensors (often redundantly provided in image forming devices), temperature control circuitry, and/or over-temperature warnings provided to indicate to an operator, or reduce, the possibility of image degradation, image damage, image receiving medium damage or damage to the image forming device due to an overheat condition.

These and other features and advantages of the disclosed embodiments are described in, or are apparent from, the following detailed description of various exemplary embodiments of the systems and methods according to this invention.

BRIEF DESCRIPTION OF THE DRAWINGS

Various exemplary embodiments of the systems and methods according to this invention will be described in detail, with reference to the following figures, wherein.

DETAILED DESCRIPTION OF PREFERRED EMBODIMENTS

Figure 1:
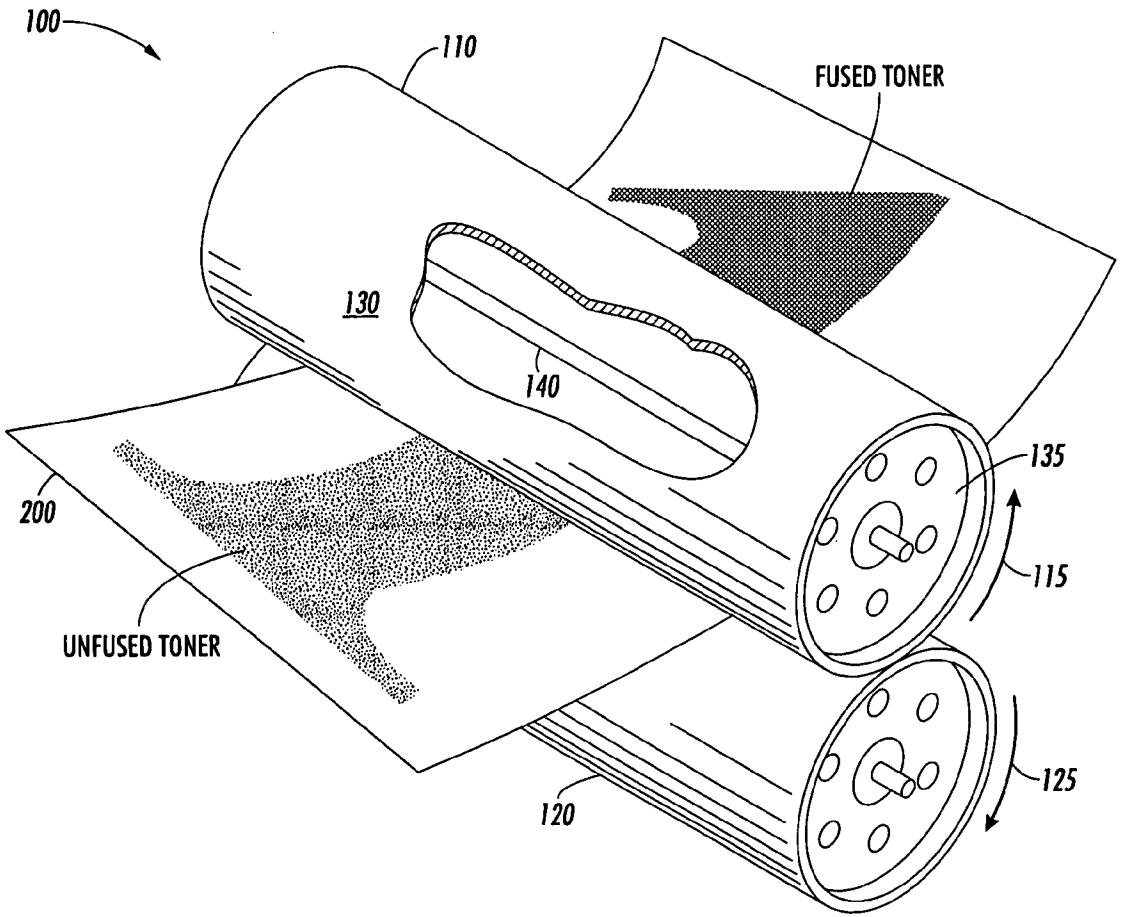
FIG. 1 CONVENTIONAL ART
FIG. 1 illustrates an exemplary embodiment of a conventional hot roll fusing device or unit.

The following description of various exemplary embodiments of heated toner fusing systems and methods according to this invention may refer to and/or illustrate one or more specific types of heated toner fusing unit for, e.g., an image forming device for the sake of ease of definition and description, clarity and familiarity. However, it should be appreciated that the principles of this invention, as outlined and/or discussed below, can be equally applied to any known or later-developed toner fusing system that employs heat and pressure to fuse toner particles onto or into the image bearing surface of an image receiving medium on which toner particles were previously deposited to form an image in an image forming device.

Exemplary image forming devices include, but are not limited to, printers, copiers, facsimile machines, multi-function image production and reproduction devices, xerographic devices and any other like device or unit in which images are produced or reproduced on image bearing surfaces of image receiving mediums using toner particles which are fused onto or into the image bearing surface of an image receiving medium by at least one of being melted and heated and pressed onto or into the image bearing surface of an image receiving medium in an image forming device.

It should be appreciated that, although discussed below and depicted in the figures as substantially a heat pipe or a heated/heatable fuser roller, the systems and methods according to this invention are not limited to such an application, but rather can be applied equally to any heatable fuser member currently available, or reasonably contemplated for use, in an image forming device. As such, this disclosure is directed to a heatable fuser member and this term will be deemed as encompassing all contemplated embodiments thereof which may include, but are not limited to, rollers, belts, or other like heated/heatable fuser devices usable to fuse dry toner onto or into image bearing surfaces of image receiving mediums in exemplary image forming devices.

Various exemplary embodiments of the systems and methods according to this invention employ a ferromagnetic layer, or a layer with high coupling efficiency to the imposed magnetic field, bonded to, or coated on, or in any other like manner applied to, a portion of the surface of a heatable fuser member, or suitable heatable fuser member core, to promote inductive heating of that portion of the haetable fuser member based on high hysteresis loss exhibited when the magnetic layer is exposed to an alternating magnetic field created by the alternating current flowing through an electrical induction coil, such as an AC electrical induction coil, or other like device. Suitable materials for the ferromagnetic layer are those which exhibit a high coupling efficiency to the imposed magnetic field. The result is substantially a controllable heating of the heatable fuser member.

Other advantages achievable using various exemplary embodiments of the systems and methods according to this invention may include a substantially controllable uniformity of temperature along an entire axial length of a heatable fuser member, and rapid warm-up of the heatable fuser member.

In various exemplary embodiments, the systems and methods according to this invention may rapidly provide, precisely control and naturally limit the heat generated in a heatable fuser member usable to fuse toner on an image receiving medium in an image forming device while reducing power consumption required to accomplish this task, and reducing the possibility of image degradation or damage based on overmelt of the toner resulting in print defects.

Figure 2:
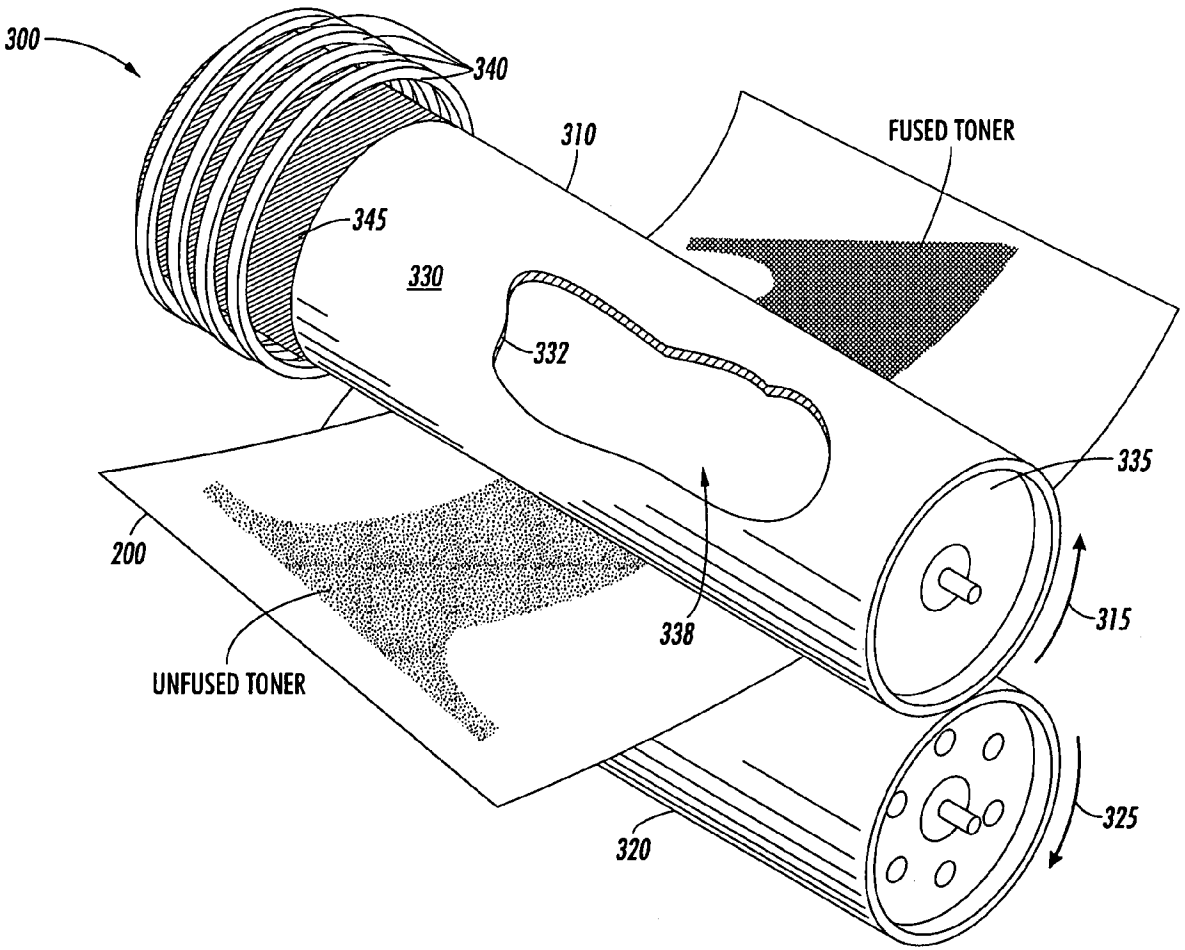
FIG. 2 illustrates an exemplary embodiment of a heated member toner fusing device or unit comprising a first exemplary embodiment of an inductively-heatable fuser member according to this invention.
Figure 3:
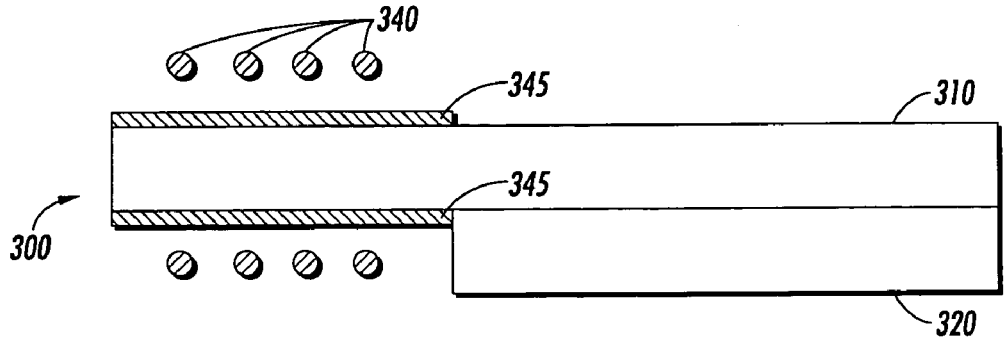
FIG. 3 is a cross-sectional view illustrating a heated member toner fusing unit or device including the first exemplary embodiment of an inductively-heatable fuser member according to this invention.

FIG. 2 illustrates an exemplary embodiment of a heated member toner fusing device 300 comprising a first exemplary embodiment of a heatable fuser member 310 according to this invention. FIG. 3 is a cross-sectional view illustrating the exemplary heated member toner fusing device 300 including the first exemplary embodiment of a heatable fuser member 310 according to this invention. As shown in FIGS. 2 and 3, the heated member toner fusing device 300 includes the heatable fuser member 310 and an opposing pressure roller 320 that rotate respectively in the directions depicted as arrows 315 and 325. The exemplary heatable fuser member 310 is formed of a hollow, a thin cylindrical wall 332 comprising a thermally-conductive material and having a cylindrical surface 330. The heatable fuser member 310 is sealed on both ends by end caps 335 thereby forming a heat pipe and may be preferably filled with a heat pipe working fluid 338.

In the exemplary embodiment of a heated member toner fusing device 300 depicted in FIG. 2, at least one electrical coil 340 is provided and connected to an electrical source, preferably a source of alternating current (not shown). The at least one electrical coil is disposed in the vicinity of a portion of the heatable fuser member 310 which includes a ferromagnetic layer 345 bonded to, coated on or in other manner applied or mated to the surface of the heatable fuser member 310 at a portion of the heatable fuser member 310 that will not contact the image bearing surface of an image receiving medium 200. The respective placement of the at least one electrical coil 340 and the ferromagnetic layer 345 results in the at least one electrical coil 340 and the ferromagnetic layer 345 being inductively coupled such that when electrical power, preferably alternating current, is applied to the at least one electrical coil 340, inductive heating of the ferromagnetic layer 345 results through a process of magnetic hysteresis. Heating of the thermally conductive cylindrical surface 330 occurs via the inductively heated ferromagnetic layer 345 and may be supported by the phase change processes of evaporation and condensation in the heat pipe fuser member when a heat pipe working fluid is present.

The ferromagnetic layer 345 may be, or include, a solid ferromagnetic sleeve fittable to a portion of the cylindrical surface 330 of the heatable fuser member 310. Alternatively, the ferromagnetic layer 345 may be, or include, a suitable ferromagnetic particulate material embedded in a thermally conductive matrix which is bonded to, coated on or otherwise applied in such a manner to provide direct thermal contact with a portion of the thermally-conductive cylindrical surface 330 of the exemplary heatable fuser member 310.

Such a portion of the thermally-conductive cylindrical surface 330 that is covered by the ferromagnetic layer 345 lies outside of the area of the heatable fuser member 310 that will contact the image bearing surface of an image receiving medium 200. Such portion will comprise preferably less than or equal to about 20% of the axial length of the heatable fuser member 310, and more preferably less than or equal to about 15% of the axial length of heatable fuser member 310. The portion will be as short as possible consistent with the maximum heating rate per unit surface area allowed by the heatable fuser member 310. As such, portions of the axial length of the heatable fuser member 310 which are designed to contact the image bearing surface of an image receiving medium will be rendered isothermal by a process of conductive heating supplemented by the phase change action of the heat pipe working fluid 338 when present.

It should be appreciated that, although the at least one electrical coil 340 and the ferromagnetic layer 345 are shown cooperatively placed at only one end of the heatable fuser member 310, other exemplary embodiments are contemplated wherein both end portions of the heatable fuser member 310 lie outside a contact area for the image bearing surface of the image receiving substrate 200 and include inductively coupled electrical coils 340 and ferromagnetic layers 345.

An exemplary opposing pressure roller 320, optionally having a relatively softer outer layer, presses against, and with the optional relatively softer outer layer optionally may mold slightly to, the heatable fuser member 310 at least in the portion of the heatable fuser member 310 which will contact the image bearing surface of the image receiving medium 200. The area where the two rollers meet is referred to as a nip.

In operation, an exemplary heated member toner fusing device 300 receives an exemplary image receiving medium 200 upon which toner has been applied to at least one image bearing surface in one or more other units or devices (not shown) internal to the exemplary image forming device. The exemplary heated member toner fusing device 300 is warmed up prior to being presented with the first exemplary image receiving medium 200 in a typical image forming operation in the exemplary image forming device. The heatable fuser member 310 and the opposing pressure roller 320 rotate in the directions depicted as arrows 315 and 325 thereby forcing the image receiving medium between the heatable fuser member 310 and the pressure roller 320. In so doing, the toner laden image receiving medium 200 is forced against the uniformly heated cylindrical surface 330 of the heatable fuser member 310. The toner previously deposited on the image bearing surface of the image receiving medium 200 is, by this exposure, heated, melted and pressed onto or into the image bearing surface of the image receiving medium 200. The combination of the heat from uniformly heated cylindrical surface 330 of the heatable fuser member 310 and the pressure exerted by the opposing pressure roller 320 in that area designed to contact the image bearing medium 200 results in the dry toner being melted and pressed, and thereby fused, onto or into the image bearing surface of the image receiving medium 200.

The ferromagnetic layer 345 is, in exemplary manner, formed from a simple or complex ferromagnetic composition which provides for selection and/or manipulation of a Curie temperature of the ferromagnetic substance. The Curie temperature or point is that elevated temperature which when passed in a heating cycle or operation results in the ferromagnetic substance losing its ferromagnetic characteristic and exhibiting paramagnetic properties. Above the Curie temperature or point then, with the loss of its ferromagnetic characteristic, the ferromagnetic layer 345 no longer supports hysteresis loss. As a result, the inductive heating of the ferromagnetic layer 345, and coincidentally the heating of the thermally-conductive cylindrical surface 330 of the exemplary heatable fuser member 310, ceases and the ferromagnetic layer 345 and the cylindrical surface 330 begin to cool. When the temperature in the ferromagnetic layer 345 decreases below its Curie point, the ferromagnetic properties of the ferromagnetic layer 345 return and temperature rise due to hysteresis loss resumes.

It should be recognized, therefore, that by choosing a material with an appropriate Curie temperature for the ferromagnetic layer, adequate toner fusing may be supported while overall temperature may be coincidentally self-controlled. This reduces or potentially eliminates a requirement for additional temperature sensing and control apparatus.

Figure 4:
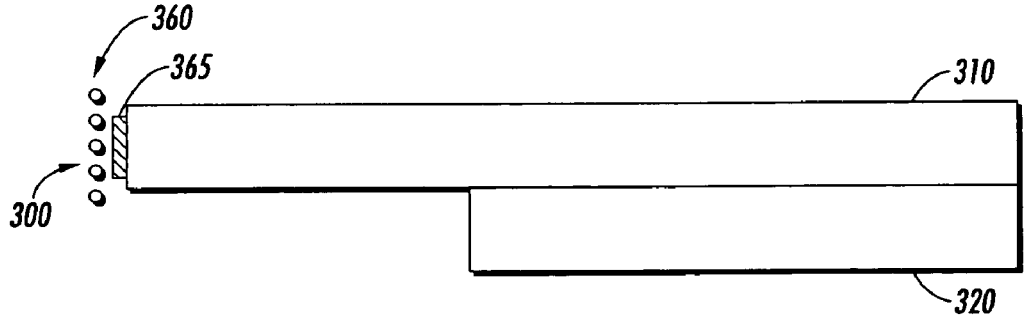
FIG. 4 is a cross-sectional view illustrating a heated member toner fusing device or unit including a second exemplary embodiment of an inductively-heatable fuser member according to this invention.

FIG. 4 is a cross-sectional view illustrating an exemplary heated member toner fusing device 300 including a second exemplary embodiment of an heatable fuser member 310 according to this invention. As shown in FIG. 4, a ferromagnetic layer 365 is placed at the end of the exemplary heatable fuser member 310, such as, for example, on the end cap of the heatable fuser member 310. In such case, a spiral electrical coil and/or other flat plate electrical coil 360 is provided to be inductively linked to the ferromagnetic layer 365 in order that induction heating may occur when electrical power is applied to the spiral or flat plate electrical coil 360.

It should be appreciated that inclusion of a fluid medium, or a multi-phase liquid and vapor medium, in order to aid in providing uniform temperature control across the entire axial length of an exemplary heatable fuser member 310 is contemplated, as noted above, but not required. In such case that no working fluid is used, the ends of the heatable fuser member 310 could be vented or otherwise left open.

Further, it should be appreciated that the systems and methods according to this invention are not limited to the exemplary heatable fuser members shown and described above as exemplary embodiments of fuser members, but rather can be applied to any heatable fuser member to a portion of which a ferromagnetic layer may be applied such as, for example, rollers, belts, or any other like heatable surfaces usable to fuse dry toner onto or into the image bearing surfaces of image receiving mediums in exemplary image forming devices.

While this invention has been described in conjunction with the exemplary embodiments outlined above, various alternatives, modifications, variations and/or improvements, whether known or that are, or may be, presently unforeseen, may become apparent. Accordingly, the exemplary embodiments of the invention, as set forth above, are intended to be illustrative, not limiting. Various changes may be made without departing from the spirit and scope of the invention. Therefore, the systems and methods according to this invention are intended to embrace all now known or later-developed alternatives, modifications, variations and/or improvements.

What is claimed is:

1. A heated member toner fusing system, comprising:

a heatable fuser member including an image contact region that contacts an image receiving medium to melt toner that has been deposited on the image receiving medium, the heatable fuser member comprising a core of a thermally-conductive material and a ferromagnetic layer in sufficient contact with the heatable fuser member to establish a heat flow path between the ferromagnetic layer and the thermally-conductive core of the heatable fuser member, the ferromagnetic layer extending along a first portion of the heatable fuser member that is outside the image contact region, the ferromagnetic layer not extending along a second portion of the heatable fuser member that is inside the image contact region; and at least one electrical coil in proximity to the ferromagnetic layer, the placement of the at least one electrical coil promoting inductive coupling of the at least one electrical coil and the ferromagnetic layer such that, when electrical power is applied to the at least one electrical coil, inductive heating of the ferromagnetic layer results, the thermally-conductive core of the heatable fuser member being at least one of conductively and convectively heated across the heat flow path established with the inductively-heated ferromagnetic layer.

2. The system of claim 1, wherein the heatable fuser member comprises at least one of a heatable fuser roller and a heat pipe.

3. The system of claim 2, wherein the ferromagnetic layer covers a portion of a cylindrical surface of the at least one of the heatable fuser roller and the heat pipe at at least one end of the at least one of the heatable fuser roller and the heat pipe.

4. The system of claim 3, wherein the ferromagnetic layer comprises at least one of (a) a solid ferromagnetic sleeve fitted to the cylindrical surface and (b) a ferromagnetic particulate material embedded in a thermally conductive matrix coated on the cylindrical surface.

5. The system of claim 4, wherein the at least one electrical coil is substantially circular, the at least one substantially circular electrical coil surrounding and being substantially concentric with the at least one end of the cylindrical surface covered by the ferromagnetic layer.

6. The system of claim 2, wherein the ferromagnetic layer contacts at least one end cap of the at least one of the heatable fuser roller and the heat pipe.

7. The system of claim 6, wherein the ferromagnetic layer comprises at least one of (a) a solid ferromagnetic object fitted to the at least one end cap of the heatable fuser roller and (b) a ferromagnetic particulate material embedded in a thermally conductive matrix coated on the at least one end cap.

8. The system of claim 7, wherein the at least one electrical coil is at least one of a substantially spiral coil and a substantially flat plate coil.

9. The system of claim 2, wherein, when the at least one of the heatable fuser roller and the heat pipe comprises the heat pipe, the heat pipe is sealed on both ends to provide a sealed internal cavity.

10. The system of claim 9, wherein the sealed internal cavity is filled with at least one of a fluid medium and a multi-phase liquid/gas medium in equilibrium to promote consistency in heating the heat pipe.

11. The system of claim 1, wherein the ferromagnetic layer comprises a ferromagnetic material with a Curie temperature that is higher than a temperature required to melt the toner.

12. The system of claim 11, wherein the Curie temperature is lower than a temperature which will cause at least one of damage to an image, damage to an image receiving medium and damage to a component in an image forming device.

13. The system of claim 1, wherein the image contact region of the heatable fuser member is coated with a thermally-conductive non-sticking material to reduce the potential of melted toner being transferred to a heated surface of the heatable fuser member.

14. The system of claim 1, further comprising a pressure device having a surface opposing the heatable fuser member in at least the image contact region, the pressure device providing a pressing force usable to press the toner that has been deposited on the image receiving medium onto or into an image bearing surface of the image receiving medium as the toner is melted by contact with the conductively heated surface of the heatable fuser member when the image receiving medium is passed between the image contact region of the heated heatable fuser member and the opposing pressure device.

15. The system of claim 14, wherein the surface of the pressure device comprises a relatively soft outer layer such that, when the pressing force is exerted, the softer outer layer of the pressing device tends to conform to the surface of the heatable fuser member.

16. An image forming device including the system of claim 1.

17. A method for fusing dry toner on an image receiving medium, comprising:

inductively heating a heatable fuser member including an image contact region that contacts an image receiving medium to melt toner that has been deposited on the image receiving medium, the heatable fuser member comprising a core of a thermally-conductive material and a ferromagnetic layer in sufficient contact with the heatable fuser member to establish a heat flow path between the ferromagnetic layer and the thermally-conductive core of the heatable fuser member, by inductively coupling at least one electrical coil to the ferromagnetic layer extending along a first portion of the thermally-conductive core of the heatable fuser member that is outside the image contact region, the ferromagnetic layer not extending along a second portion of the heatable fuser member that is inside the image contact region, such that, when alternating current electrical power is applied to the at least one electrical coil, inductive heating of the ferromagnetic layer results;

at least one of conductively and convectively heating the thermally-conductive core of the heatable fuser member across a heat flow path established between the inductively-heated ferromagnetic layer and the thermally-conductive core of the heatable fuser member; and passing an image bearing surface of an image receiving medium across the thermally-conductive core of the heatable fuser member in the image contact region of the heatable fuser member to melt toner previously deposited on the image bearing surface of the image receiving medium thereby fusing the toner onto the image bearing surface of the image receiving medium.

18. The method of claim 17, further comprising exerting a pressing force to press the melted toner onto or into the image bearing surface of the image receiving medium thereby further fusing the melted toner onto or into the image bearing surface of the image receiving medium.

* * * * *